US007077204B2

(12) United States Patent
Cruickshank et al.

(10) Patent No.: US 7,077,204 B2
(45) Date of Patent: Jul. 18, 2006

(54) WHIP RETRIEVAL METHOD AND APPARATUS

(75) Inventors: Brian Cruickshank, The Woodlands, TX (US); Charles Dewey, Houston, TX (US); Wei Xu, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/176,595

(22) Filed: Jun. 21, 2002

(65) Prior Publication Data

US 2003/0047318 A1 Mar. 13, 2003

Related U.S. Application Data

(60) Provisional application No. 60/300,763, filed on Jun. 25, 2001.

(51) Int. Cl.
*E21B 31/12* (2006.01)
*E21B 23/00* (2006.01)

(52) U.S. Cl. ..... 166/301; 166/98; 166/117.5; 166/377

(58) Field of Classification Search ..... 166/98, 166/117.5, 117.6, 301, 377; 294/86.12, 86.25, 294/86.16
See application file for complete search history.

(56) References Cited

U.S. PATENT DOCUMENTS 1,761,943 A * 6/1930 Summers et al. ..... 251/337
4,004,835 A 1/1977 Taylor ..... 294/86.29
5,427,179 A * 6/1995 Bailey et al. ..... 166/117.6
5,535,822 A 7/1996 Schock et al. ..... 166/50
5,678,634 A 10/1997 Rehbock et al. ..... 166/377
5,909,770 A * 6/1999 Davis ..... 166/117.6
6,012,527 A * 1/2000 Nitis et al. ..... 166/313
6,076,606 A * 6/2000 Bailey et al. ..... 166/117.6
6,089,319 A * 7/2000 Singleton ..... 166/298

OTHER PUBLICATIONS

Great Britain Patent Office Search Report dated Oct. 1, 2002; 2 pages.

* cited by examiner

*Primary Examiner*—David Bagnell
*Assistant Examiner*—Shane Bomar
(74) *Attorney, Agent, or Firm*—Osha Liang LLP

(57) ABSTRACT

The retrieval tool includes a cylindrical member having a body, an inner passage, a guide cylinder and an engaging member. The engaging member may slide within the cylindrical member in order to frictionally engage a whipstock against an inner surface of the guide cylinder, facilitating removal of the whipstock from a borehole. A actuating member, piston, retainer and swivel sub may be used to connect the engaging member to the retrieval tool and enhance the mobility of the engaging member within the cylindrical member. A spring may also facilitate locking engagement of the engaging member and whipstock. Contact between the retrieval tool and the whipstock may lead to an increase of pressure within the inner passage, such pressure increasing the engagement between the engaging member and whipstock.

20 Claims, 3 Drawing Sheets

WHIP RETRIEVAL METHOD AND APPARATUS

CROSS-REFERENCE TO RELATED APPLICATIONS

This Application claims the benefit of U.S. Provisional Patent Application No. 60/300,763, filed on Jun. 25, 2001.

BACKGROUND OF INVENTION

1. Field of the Invention

The invention relates generally to whipstocks for diverting the direction of drilling. More specifically, the invention relates to a method and apparatus for retrieving a whipstock from a wellbore.

2. Background Art

Traditionally, whipstocks have been used to drill a deviated borehole from an existing wellbore. A whipstock has a ramped surface which is set in a predetermined position to guide the drill bit or drill string in a deviated manner to drill into the side of the borehole. In operation, the whipstock is set on the bottom of the existing borehole, the set position of the whipstock is surveyed, and the whipstock is properly oriented for directing the drill string in the proper direction. After the whipstock is set, a drill string is lowered into the well into engagement with the whipstock causing the whipstock to orient the drill string to drill a deviated borehole through the wall of the existing borehole.

Other uses for whipstocks include instances where previously drilled and cased well bores, for one reason or another, have become nonproductive. For example, when a well bore becomes unusable, a new borehole may be drilled in the vicinity of the existing cased borehole or alternatively, a new borehole may be sidetracked from the serviceable portion of the existing cased wellbore. Sidetracking from a cased borehole may also be useful for developing multiple production zones. This procedure can be accomplished by milling through the side of the casing with a mill that is guided by a wedge or whipstock component.

After a milling or drilling procedure is completed, it is often desirable to retrieve the whipstock component from the borehole. Various tools are known in the art for retrieving whipstocks. Known methods of retrieval include using hooks, overshots, or die collars. Often, however, the whipstock incurs damage by the drilling or milling operations making retrieval by traditional means more difficult, if not impossible. Likewise, damage to a whipstock's profile can make deciding the preferred method of retrieval, and even the ability to retrieve the whipstock, less predictable. Finally, known retrieval tools and methods have a limited ability to retrieve a whipstock while utilizing a non rotary running processes, such as coil tubing.

SUMMARY OF INVENTION

In one aspect, the present invention relates to a tool for retrieving a whipstock from a wellbore. In one embodiment, the tool comprises a cylindrical member having a guide cylinder disposed at one end and an inner passage formed therein. The tool further comprises an engaging member adapted to frictionally engaging with the whipstock.

In another aspect, the present invention relates to a method for retrieving a whipstock from a wellbore. In one embodiment, the method includes lowering a retrieval tool into a wellbore, guiding the whipstock into a guide cylinder, engaging the whipstock frictionally between an engaging member and a surface of the guide cylinder and removing the whipstock frictionally engaged in the retrieval tool from the wellbore.

Other aspects and advantages of the present invention will be apparent from the following description and the appended claims.

DETAILED DESCRIPTION

Figure 1:
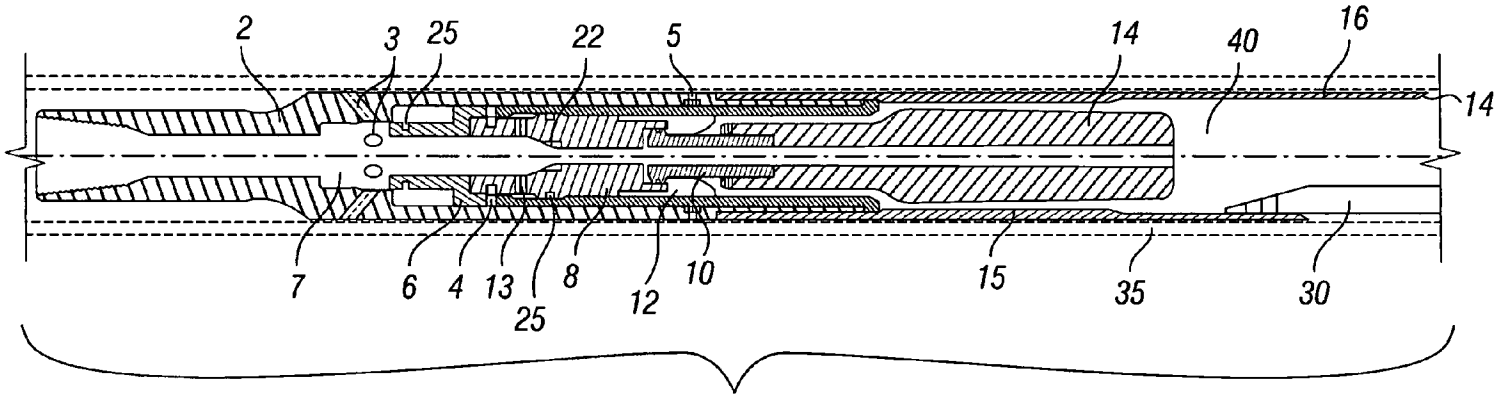
FIG. 1 shows a side, cross sectional view of one embodiment of the retrieval tool, wherein a whipstock is initially engaged by the tool.

Embodiments of the invention will now be described with reference to the accompanying figures, wherein like reference characters are used for like features throughout the several views.

Referring to FIG. 1, there is shown one embodiment of a whipstock retrieval tool in a cased well bore 35 (shown in phantom) and a top portion of a whipstock 30. To facilitate the attachment of the retrieval tool to a work string (not shown), a cylindrical member 1 of the tool may be provided with conventional internal or box threads at its upper end for connection to a work string. Alternatively, the upper end of the cylindrical member 1 may include a top sub (not shown in FIG. 1) that is provided with internal or box threads for connection to a work string. Other connection methods known in the art may also be used to connect the tool to a work string. It will be appreciated by those skilled in the art that the retrieval tool may be run using a conventional drill string, coiled tubing, or other know running methods. In a preferred embodiment of the method of the present invention, the retrieval tool will be run in conjunction with coiled tubing.

As shown in FIG. 1, the retrieval tool includes a cylindrical member 1 comprised of a body 2 and guide cylinder 16. The cylindrical member 1 need not be cylindrical in shape. The shape of the cylindrical member 1 may vary based on practical and manufacturing considerations. In a preferred embodiment, at least the guide cylinder 16 will have a cylindrical profile. The body 2 and guide cylinder 16 may be formed of separate pieces (as shown) or may comprise a single unit (not shown). Furthermore, the top sub (not shown in FIG. 1) may be integral with the body 2 or may be formed of a separate piece. The retrieval tool also includes an engaging member 14 for engagement with the whipstock 30. For illustrative purposes, the engaging member 14 shown is a wedge. However, the engaging member 14 may be of any shape. At least one port 3 may be provided in the cylindrical member 1 to allow for fluid communication between an inner passage 7 and the wellbore. An actuating member 6 is slidably disposed within the inner passage 7. For illustrative purposes, the actuating member 6 is a sleeve. However, the actuating member 6 may be of any shape and be any member whose movement or alteration results in an actuation of the actuating member 6. The actuating member 6 is coupled to a piston 8 by at least one release device 4. The release device 4 may comprise a shear pin, a ball-bearing coupling, or any other mechanism known in the art to release under pressure or whose release may be triggered by other means. The cylindrical member 1 may include a snap ring 5 which will lock the actuating member 6 in a desired position. The piston 8 may have at least one port (13). The piston 8 may be separate from and coupled to the engaging member 14 (as shown) or may comprise a single unit with the engaging member 14 (not shown). At least one restricted portion 22 may be disposed within the inner passage 7 of the cylindrical member 1. The restricted portion 22 may be disposed within the piston 8, engaging member 14, or at any other point along the inner passage 7 between a port 3 and the distal end of the engaging member 14. The restricted portion 22 may comprise a narrowing of the inner passage 7. In other embodiments, a ball seat, nozzle, or any other device or technique known in the art for restricting flow through a chamber may be used in conjunction with the restricted portion 22. The restricted portion 22 may also include any device or configuration resulting in a pressure differential of the flow upstream of the restricted portion 22 as compared with the flow downstream of the restricted portion 22. In the embodiment shown in FIGS. 1, 2 and 3, the restricted portion 22 includes a ball seat. In an alternative embodiment, the restricted portion 22 includes a nozzle.

In one embodiment a swivel sub 10 and/or a retainer 12 is pivotally coupled to the piston 8 or engaging member 14, thus allowing the engaging member 14 to pivotally move within the inner passage 7 formed within cylindrical member 1. A lip 17 may be formed at an end of the guide cylinder 16 and may be tapered inward to facilitate guidance of the whipstock 30 into the inner passage 7 of the guide cylinder 16. In the embodiments shown in FIGS. 1, 2, and 3, the leading edge of the guide cylinder 16 is longer on one side relative to an opposite side. The variation in length along the leading edge of the guide cylinder 16 in such an embodiment increases the likelihood that the longer side of the guide cylinder 16 will contact the tip (31 in FIG. 2) of the whipstock 30, thereby using the rotational force of a rotary-type running process to help disengage the whipstock 30 from the inner surface of a wellbore 35.

Figure 2:
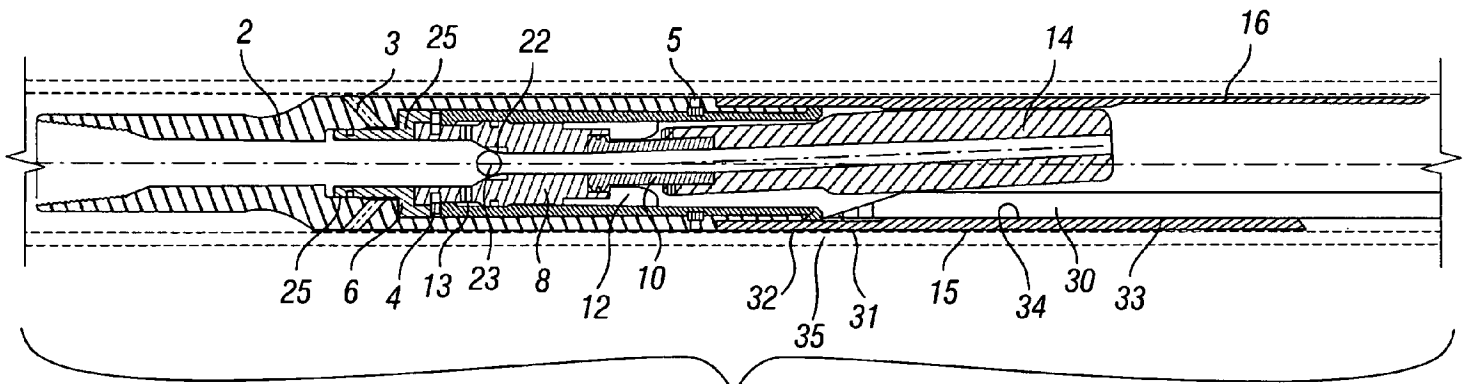
FIG. 2 shows a side, cross sectional view of one embodiment of the retrieval tool wherein a whipstock is partially engaged by the guide cylinder and the engaging member.

Referring to FIG. 2, after initial engagement of the whipstock 30 with the guide cylinder 16, the cylindrical member 1 is lowered onto the whipstock 30 until the tip 31 of the whipstock 30 contacts the actuating member 6 or a actuating member cap (not shown in FIG. 2) located at one end of the actuating member 6. The tip 31 of the whipstock 30 moves up the inner passage 7, the actuating member 6, piston 8, swivel sub 10, retainer 12 and engaging member 14 are pushed upwards within the inner passage 7 such that the actuating member 6 blocks the ports 3. When the actuating member 6 blocks the ports 3, a pressure change occurs thus signaling the partial engagement of the whipstock 30 with the retrieval tool. Seals 25 may be used within the cylindrical member 1 to enhance blockage of the ports 3.

Figure 3:
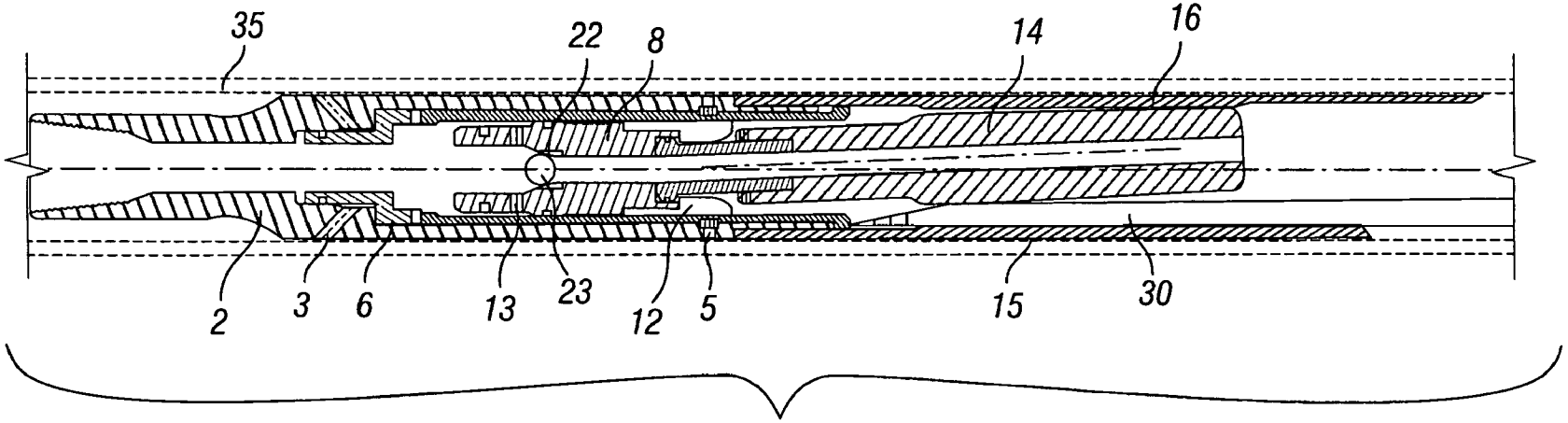
FIG. 3 shows a side, cross sectional view of one embodiment of the retrieval tool wherein the whipstock is fully engaged by the tool and ready to be retrieved.

Referring to FIG. 3, after the actuating member 6 blocks the ports 3, pressure is increased such that the release device 4 releases the coupled engagement of the piston 8 with the actuating member 6. This pressure increase may be facilitated by flow through the restricted portion 22 in an embodiment where the restricted portion 22 includes a nozzle. In the embodiments shown in FIGS. 2 and 3, a ball 23 is seated in the restricted portion 22, to enhance the pressure buildup to release the shear device 4. When the shear device 4 releases, the piston 8, swivel sub 10, retainer 12 and engaging member 14 move axially towards the whipstock 30, and secure the whipstock 30 between the engaging member 14 and an inner surface (34 in FIG. 2) of the guide cylinder 16. The inner surface (34 in FIG. 2) of the guide cylinder 16 lockingly engages an outer surface 33 of the whipstock 30. After the whipstock 30 is lockingly engaged between the engaging member 14 and inner surface of the guide cylinder 34, tension may then be applied to retrieve the whipstock 30 from the borehole.

One characteristic that may affect the strength of the engagement between the whipstock 30 and the retrieval tool is treatment of the outer surface of the engaging member 14, outer surface of the whipstock 30, or the inner surface of the guide cylinder 34. Such treatment may include textures or coatings. Textures may include threads, dimples, wickers, and other surface topography known in the art to facilitate engagement of two adjacent surfaces. The dimensions and geometry of the engaging member 14 may also be varied to achieve the desired level of engagement between the retrieval tool and the whipstock 30. In an alternative embodiment, the weight of the engaging member 14 may also be adjusted to alter the strength of engagement between the retrieval tool and the whipstock 30.

Figure 4:
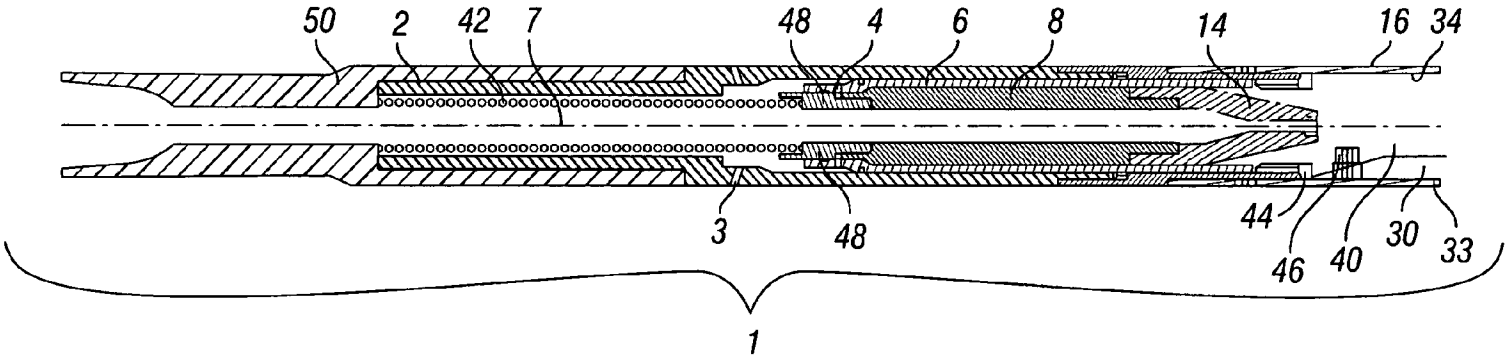
FIG. 4 shows a side, cross sectional view of one embodiment of the retrieval tool wherein the whipstock is initially engaged by the tool.
Figure 5:
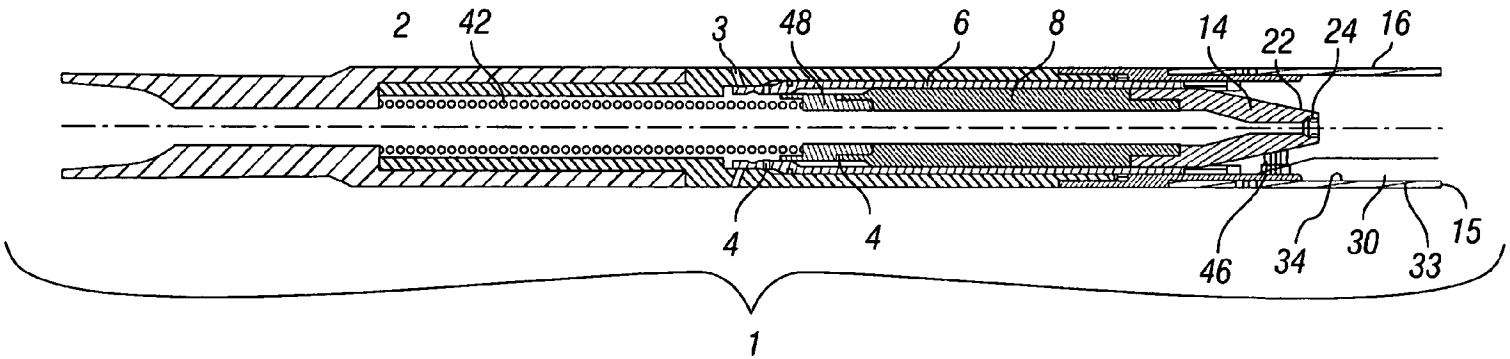
FIG. 5 shows a side, cross sectional view of an embodiment of the retrieval tool wherein the whipstock is engaged by the tool.

In another embodiment shown in FIGS. 4 and 5, actuating member 6 is coupled to piston 8 by at least one release device 4. The release device 4 may attach directly to the actuating member 6, or may be attached to a release device retainer 48, or may lie between the actuating member 6 and release device retainer 48 or in any other location within the cylindrical member 1 that will allow movement of the engaging member 14 relative to the actuating member 6, upon release of the release device 4. The guide cylinder 16 may end in a lip (17 in FIG. 1) which is tapered to facilitate guidance of the whipstock 30 into the inner passage 7. The inner surface of the guide cylinder 34, outer surface of the whipstock 33 and the surface of the wedge 14 may be treated to achieve a desired strength of engagement between them. The engaging member 14 is coupled to the piston 8 which is coupled to the release device retainer 48. Alternatively, the wedge 14 and piston 8 may form a single piece (not shown). A spring 42 is disposed within the body 2 such that one end of the spring 42 is supported by the body 2 or a top sub 50 (as shown) and the other end of the spring 42 is adjacent to the release device retainer 48. Alternatively, if a release device retainer 48 is not used, one end of the spring 42 may be adjacent to the piston 8. A whipstock 30, which may include a shear bolt 46 or stub piece of the shear bolt 46 connected at its tip 31 is engaged within the guide cylinder 16. As a actuating member cap 44 engages the whipstock 30, the actuating member 6, piston 8, and engaging member 14 slide within the inner passage 7 so that fluid communication through the ports 3 is blocked. When the ports 3 are blocked, a pressure change occurs thus signaling the partial engagement of the whipstock 30 and retrieval tool. Seals (25 FIG. 2) may be used with the actuating member 6 to enhance blockage of the ports 3.

Referring to FIG. 5, after the ports 3 are blocked, pressure is increased such that the release device 4 releases. This pressure increase may be facilitated by flow through the restricted portion 22 in the embodiment where the restricted portion 22 includes a nozzle 24. Flow through such a restricted portion 22 may also have the advantage of cleaning the whipstock 30, thereby decreasing the likelihood of slippage once engaged by the tool. Alternatively, as in the embodiment shown in FIG. 2 and 3, a ball 23 may be seated in the restricted portion 22, creating additional pressure to release the release device 4. When the release device 4 releases, the piston 8, and engaging member 14 move axially towards the whipstock 30, and secure the whipstock 30 between the engaging member 14 and the inner surface of the guide cylinder 34. This axial movement is enhanced by the spring 42 which returns from its compressed position upon release of the release device 4, contributing to the force by which the engaging member 14 engages the whipstock 30 or shear bolt 46. The inner surface 34 of the guide cylinder 16 lockingly engages an outer surface 33 of the whipstock 30. In a preferred embodiment, treatment of the inner surface 34 of the guide cylinder 16 facilitates the locking engagement of the whipstock 30 within the guide cylinder 16. In another embodiment, the outer surface 33 of the whipstock 30 is also treated to facilitate secure engagement of the whipstock 30 and the retrieval tool. After the retrieval tool is lockingly engaged with the whipstock 30, tension may then be applied to the retrieval tool to retrieve the whipstock 30 from the borehole.

Alternatively, in another embodiment the tool may function in the absence of fluid or without any increase in fluid pressure. In such case, the compression of the spring 42 due to the force exerted by the whipstock 30 against the actuating member 6 or actuating member cap 44 may create sufficient buildup of force in the spring 42 to release the release device 4, and acceleration of the engaging member 14 towards the whipstock in such a fashion that a locking engagement of the whipstock 30 between the engaging member 14 and inner surface 34 of the guide cylinder 16 is achieved. The acceleration of the engaging member 30 is achieved by the return of the spring 42 to a decompressed state.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A tool for retrieving a whipstock, comprising:

a cylindrical member having a guide cylinder that accepts and frictionally engages the whipstock therein;

a tapered engaging member having two opposing longitudinally tapered portions disposed within the cylindrical member wherein the first longitudinally tapered portion of the tapered engaging member frictionally engages the whipstock and the second longitudinally tapered portion of the tapered engaging member frictionally engages the guide cylinder, thereby allowing retrieval of the whipstock; and an actuating member disposed within the cylindrical member that actuates the engaging member when the whipstock is inside the guide cylinder.

2. The tool of claim 1 wherein one end of the cylindrical member is adapted for connection to a drill string.

3. The tool of claim 1 wherein the tapered engaging member is coupled to the actuating member by at least one release device.

4. The tool of claim 3 wherein the tapered engaging member is coupled to the actuating member by at least one ball bearing coupling.

5. The tool of claim 1 wherein the tapered engaging member is actuated by a spring.

6. A tool for retrieving a whipstock, comprising:

a cylindrical member having a guide cylinder that accepts and frictionally engages the whipstock therein;

a tapered engaging member having two opposing longitudinally tapered portions disposed within the cylindrical member wherein the first longitudinally tapered portion of the tapered engaging member frictionally engages the whipstock and the second longitudinally tapered portion of the tapered engaging member frictionally engages the guide cylinder, thereby allowing retrieval of the whipstock; and an actuating member disposed within the cylindrical member that actuates the engaging member when the whipstock is inside the guide cylinder, wherein the engaging member is actuated by an increase in pressure.

7. The tool of claim 6 wherein the cylindrical member includes at least one port for fluid communication between an inner passage of the cylindrical member and a wellbore.

8. The tool of claim 7 wherein a restricted portion is disposed within the inner passage.

9. The tool of claim 8 wherein the restricted portion includes a nozzle.

10. The tool of claim 8 wherein a ball is disposed within the restricted portion to restrict flow.

11. The tool of claim 1 wherein one side of the guide cylinder is longer than an opposite side.

12. The tool of claim 1 wherein an interior wall of the guide cylinder is treated in order to more securely engage the whipstock.

13. The tool of claim 1 wherein a surface of the tapered engaging member is treated in order to securely engage the whipstock.

14. The tool of claim 1 wherein a surface of the whipstock is treated in order to securely engage the tool.

15. A tool for retrieving a whipstock, comprising:

a cylindrical member having a guide cylinder that guides and frictionally engages the whipstock;

a tapered engaging member having two opposing longitudinally tapered portions disposed within the cylindrical member wherein the first longitudinally tapered portion of the tapered engaging member frictionally engages the whipstock and the second longitudinally tapered portion of the tapered engaging member frictionally engages the guide cylinder, thereby allowing retrieval of the whipstock;

an actuating member coupled to the tapered engaging member by at least one release device that causes actuation of the tapered engaging member when the whipstock is inside the guide cylinder; and a spring disposed in the cylindrical member that actuates engagement of the tapered engaging member with the whipstock.

16. A method for retrieving a whipstock from a wellbore, comprising:

lowering a retrieval tool into a wellbore, the retrieval tool having a guide cylinder disposed at one end;

lowering the guide cylinder over the whipstock, such that the whipstock enters the guide cylinder;

engaging the whipstock between a tapered engaging member and an interior wall of the guide cylinder, wherein the tapered engaging member has two opposing longitudinally tapered portions;

wherein the whipstock is frictionally engaged between the first longitudinally tapered portion of the tapered engaging member and an interior wall of the guide cylinder and wherein the second longitudinally tapered portion of the tapered engaging member is frictionally engaged with the guide cylinder, thereby allowing retrieval of the whipstock; and retrieving the tool from the wellbore.

17. The method of claim 16 wherein a cylindrical member of the retrieval tool detachably connects to a work string.

18. The method of claim 17 wherein the work string comprises coiled tubing.

19. The method of claim 16 further comprising increasing pressure within an inner passage of the cylindrical member to release at least one release device, thereby freeing the tapered engaging member to enable the locking engagement of the whipstock against the interior wall of the guide cylinder.

20. The method of claim 16 further comprising decompressing of a spring within the cylindrical member to accelerate the tapered engaging member in order to more securely engage the whipstock against the interior wall of the guide cylinder.

* * * * *